United States Patent [19]

Addicks et al.

[11] 4,122,564

[45] Oct. 31, 1978

[54] DUAL DISCHARGE VALVE UNIT

[76] Inventors: Lyle F. Addicks, 12313 Brookshire Ave., Downey, Calif. 90242; Bennie Gift, 9527 Brock Ave., Downey, Calif. 90240; William R. DiCicco, Jr., 7033 Stewart & Gray Rd. #46, Downey, Calif. 90241

[21] Appl. No.: 836,086

[22] Filed: Sep. 23, 1977

[51] Int. Cl.[2] ..... E03D 1/14

[52] U.S. Cl. ..... 4/326; 4/412; 4/415; 4/DIG. 1

[58] Field of Search ..... 4/67 A, 67 R, 249, 250, 4/DIG. 1, 18 R, 326, 325, 324, 412, 415

[56] References Cited

U.S. PATENT DOCUMENTS

| | | | |
|---|---|---|---|
| 2,864,095 | 12/1958 | Martino | 4/67 A |
| 2,908,914 | 10/1959 | Lasecki | 4/67 A |
| 3,909,856 | 10/1975 | Dunn | 4/67 A |
| 3,913,149 | 10/1975 | Brinton | 4/67 A |
| 4,042,982 | 8/1977 | Contreras | 4/67 A |

*Primary Examiner*—Richard E. Aegerter
*Attorney, Agent, or Firm*—John T. Matlago

[57] ABSTRACT

An improved dual discharge valve unit is provided for easy installation in an existing water closet flush tank. The unit provides flap valves disposed at two different levels in the tank for controlling the discharge of water therefrom. The structural arrangement is such that depending on the direction in which the actuating handle on the tank is pivoted either a full flush or a partial flush may be had as desired.

8 Claims, 5 Drawing Figures

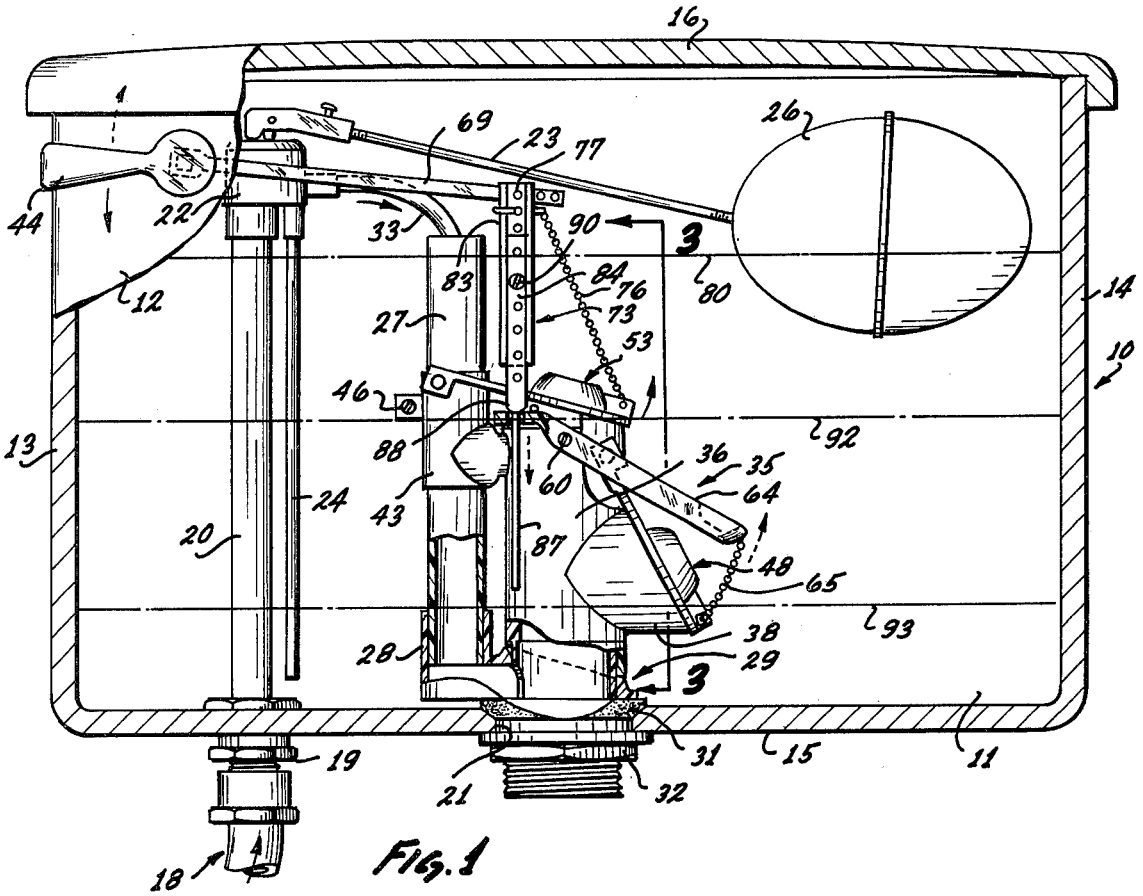
FIG. 1
FIG. 2
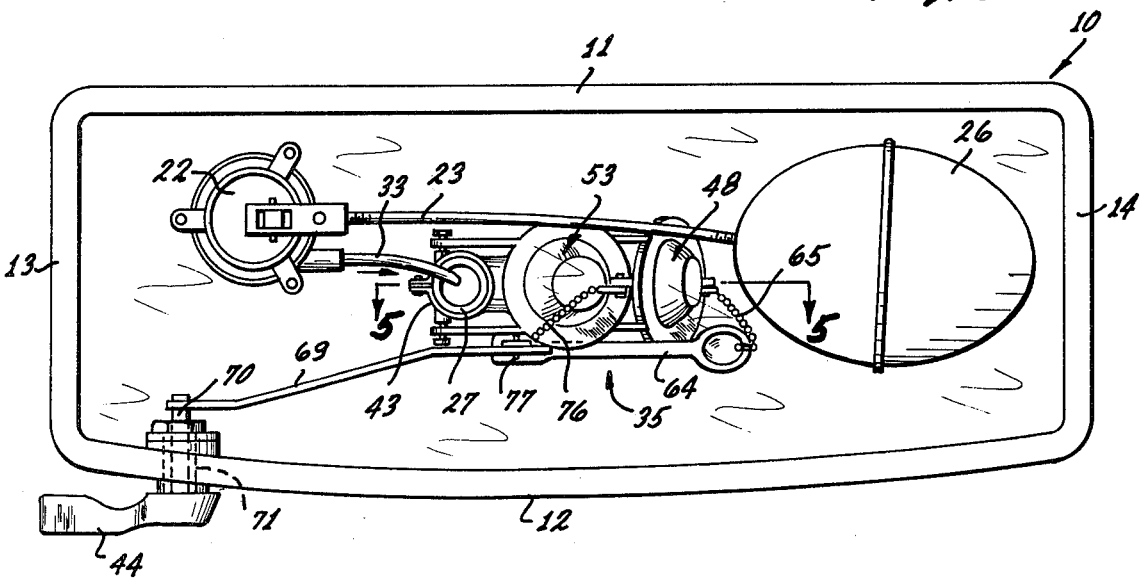

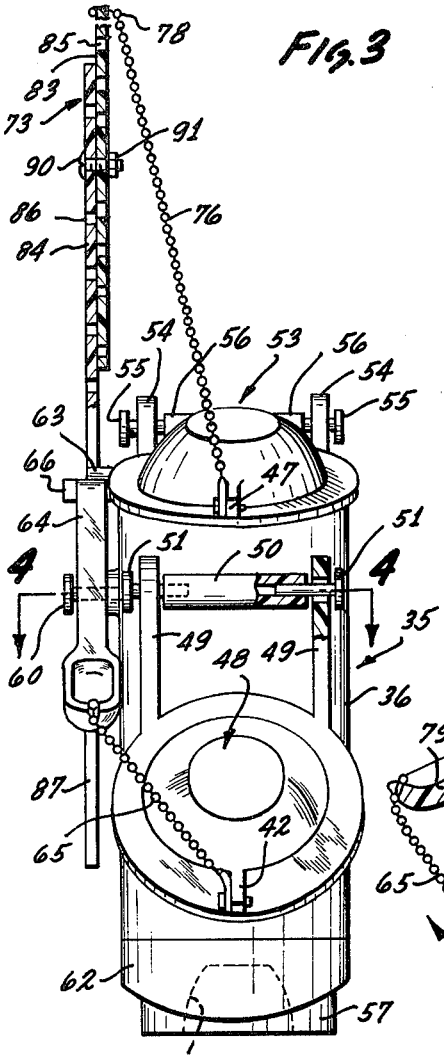
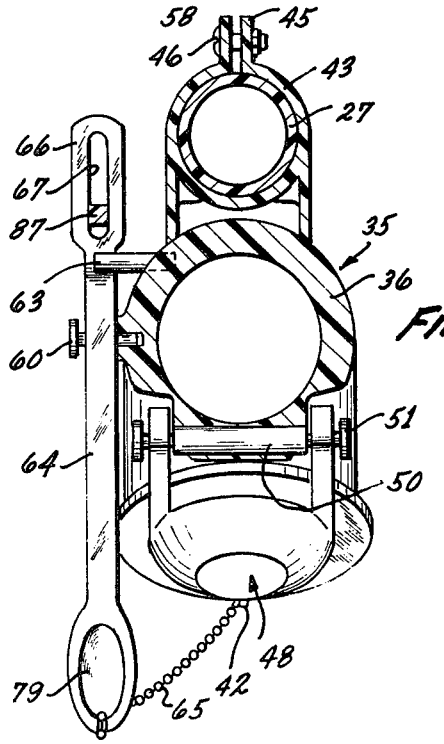
FIG. 4
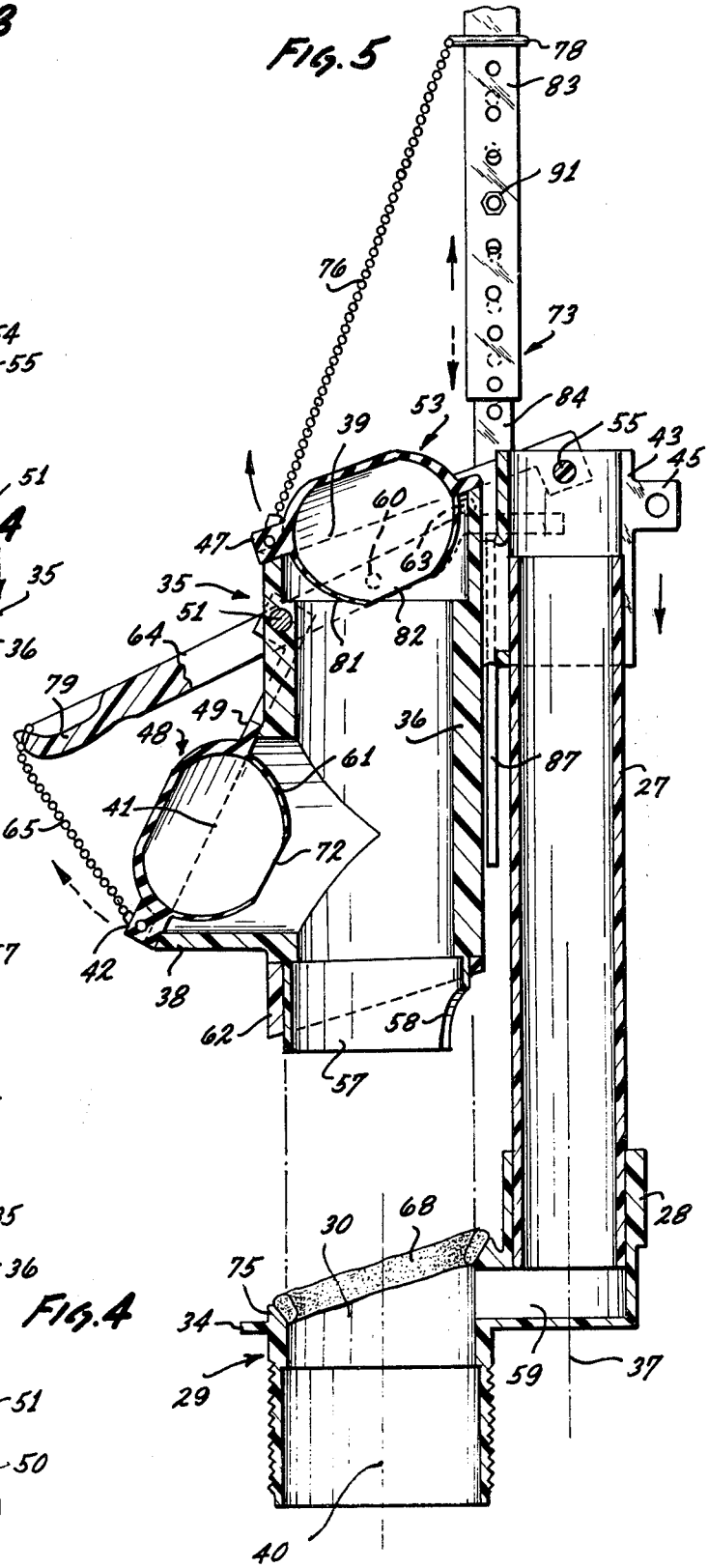

DUAL DISCHARGE VALVE UNIT

BACKGROUND OF THE INVENTION

This invention relates to water closets and more particularly to improved dual discharge valve units for controlling the flow of water from flush tanks therefor.

Because of the drought conditions that exist in many geographical areas, there is a critical shortage of water available for home usage. It is well known that the water closet or toilet accounts for a substantial amount of the water used in the average home. Further, it is well known that the entire water content of the flush tank is obviously not always needed to adequately flush the closet bowl. Accordingly, devices have been provided in the past to solve the problem of wasted water by controlling the discharge from the flush tank whereby either a full flush or a partial flush may be had as desired. However, the devices previously provided for this purpose have proved unsatisfactory since they were not adapted for easy installation in existing water closet flush tanks.

SUMMARY OF THE INVENTION

In accordance with the present invention, a dual discharge valve unit is provided which is especially designed so that it can be simply installed in an existing flush tank. The dual discharge valve unit comprises an upright drain pipe having a lower inlet branch. The bottom end of the drain pipe is adapted to be seated with a water tight seal on the port of an outlet fitting which is ordinarily provided in the bottom of a flush tank for seating a ball or flap type valve. The drain pipe provides an upper level valve port on the top thereof and a lower level valve port on its inlet branch. Hingedly held upper and lower flap valves are seated on the respective upper and lower level ports. A lever having a slot on the back end thereof is pivotally mounted on the side of the drain pipe. A vertically disposed rod having a shoulder intermediate the ends thereof has its lower end portion freely inserted in the end slot on the lever. A lower chain links the free end of the lower flap valve to the front end of the lever and an upper chain links the free end of the upper flap valve to the upper portion of the rod. The upper end of the rod is coupled to an arm ordinally pivotally operated by an actuating handle on the outer wall of the tank. By such a structural arrangement, when the actuating handle is pivoted counterclockwise, the rod is moved upwardly to thereby lift the upper flap valve and provide for a partial flush of the water closet bowl. On the other hand, when the actuating handle is pivoted clockwise, the rod is moved downwardly whereby the shoulder thereon engages the slotted end of the lever and causes it to rock about its pivot mounting to thereby lift the lower flap valve and provide for a full flush of the water closet bowl.

Accordingly, one of the objects of the present invention is to provide an improved dual discharge valve unit for a flush tank that provides for controlling the discharge of water therefrom whereby either a full flush or a partial flush of a water closet may be had as desired.

Another object of the present invention is to provide a dual discharge valve unit which can be readily installed in an existing water closet flush tank by an unskilled homeowner.

Still another object of the present invention is to provide a dual discharge valve unit which can be simply installed on an outlet fitting ordinarily provided in an existing water closet flush tank.

With these and other objects and advantages in view, the invention consists of the construction, arrangement and combination of the various parts of the device whereby the objects contemplated are attained as herein set forth, pointed out in the appended claims and illustrated in the accompanying drawings.

BRIEF DESCRIPTION OF THE DRAWINGS

FIG. 1 is a vertical sectional view of a water closet flush tank showing the dual discharge valve unit of the present invention mounted therein;

FIG. 2 is a top plan view of the water closet flush tank in FIG. 1 with the cover removed;

FIG. 3 is a view of the dual discharge valve unit as viewed along line 3—3 in FIG. 1;

FIG. 4 is a view of the dual discharge valve unit, partly in section, as taken along line 4—4 in FIG. 4; and FIG. 5 is an elevational sectional view as taken along line 5—5 of FIG. 2 showing the dual discharge valve unit being installed on the overflow pipe of the outlet fitting ordinarily provided in a flush tank.

DETAILED DESCRIPTION OF THE PREFERRED EMBODIMENT

Referring to the drawings, a water closet flush tank 10 which is of conventional design includes a back wall 11, a front wall 12, side walls 13 and 14 and a bottom wall 15. The tank is provided with a removable cover 16. Water is supplied to the tank 10 by way of the usual water supply pipe 18 which is connected to a pipe coupler 19 that extends through and is mounted on the bottom wall 15 of the tank. The water supply pipe 18 continues up from the pipe coupler 19 as pipe 20 which has a supply valve 22 on the upper end thereof. A pipe 24 extending down from supply valve 22 introduces the water passed thereby into the interior of the tank. A ball float 26 provided with a float arm 23 is attached to regulate the water supply valve 22. A conventional upright overflow pipe 27 is provided in the central part of the tank 10 with its lower end secured in an offset socket 28 of an outlet fitting 29 having a threaded lower end which extends through an opening 21 in the bottom of the tank leading to the closet bowl. The outlet fitting 29 has a flange 34 by which it is seated on a gasket 31 disposed in opening 21. The outlet fitting 29 is secured in position by a nut 32 engaging its threaded lower end. It should be noted that the axis 37 of the socket 28 in which the overflow pipe 27 is mounted is offset a fixed distance from the axis 40 of the opening in the outlet fitting 29 and that the lower end of the socket 28 communicates with the outlet fitting 29 by a lateral opening 59. The outlet fitting 29 is provided with a port 30 whose upper lip 75 may be disposed to have an acute angle with the horizontal.

A bowl refill tube 33 extends from the supply valve 22 to the overflow pipe 27. Whenever the full water level 80 of the tank 10 is lowered by discharging water therefrom the ball float 26 is lowered, opening the supply valve 22. This admits water from the supply pipe 18 on through the pipe 24 into the interior of the tank 10 and also through the bowl refill tube 33 into the closet bowl. An arm 69 is secured on the end of a shaft 70 which is rotatably mounted in a sleeve bushing 71 which extends through the front wall 12 of the tank 10. The shaft 70 is pivoted about its axis by an actuating handle 44 connected on the end thereof that extends from the front wall 12.

The apparatus so far described is conventionally provided in an existing flush tank along with a ball or flap type valve which is ordinarily seated on the port 30 of the outlet fitting 29 and coupled by a linkage to the arm 69. However, this ball or flap type valve and linkage are not shown in the drawings because for the purpose of embodying the present invention, they are removed from the existing tank.

As best illustrated in FIGS. 3, 4 and 5, the dual discharge valve unit 35 of the present invention preferably comprises a molded drain pipe 36 having a lower inlet branch 38. The drain pipe 36 has on the top thereof an upper valve port 39 which is disposed at an acute angle with the horizontal and its inlet branch 38 has on the end thereof a lower valve port 41 which is disposed at an acute angle with the vertical. A cylindrical bracket 43 is provided on the back of the drain pipe 36. The bracket 43 is formed with ears 45 which can be clamped together by a nut and bolt combination 46. Positioned to be seated on the valve port 41 is a lower flap valve 48 having on its lower side an extending hollow ball like portion 61 with a bottom opening 72. The lower flap valve 48 has a pair of extending arms 49 on the back thereof by which it is hinged on pins 51 inserted on the opposite ends of a transverse rod-like projection 50 molded on the front upper side of the drain pipe 36. An upper flap valve 53 which is shaped similarly to a lower flap valve 48 with an extending hollow ball like portion 81 and a bottom opening 82 is positioned to be seated on the valve port 39. Upper flap valve 53 has a pair of extending arms 54 on the back thereof by which it is hinged on pins 55 inserted in bosses 56 molded on the sides of the cylindrical bracket 43. The bottom end portion 57 of the drain pipe 36 is reduced in diameter and formed with a cutout 58 on the back thereof such that when fitted in port 30 the cutout 58 is positioned opposite the lateral opening 59 communicating with the offset socket 28 on the side of the outlet fitting 29. An angular adaptor 62 is fitted over the reduced diameter bottom end of the drain pipe 36 to enable it to be seated against the angularly disposed port 30 on the outlet fitting 29.

Pivotally mounted on a pin 60 provided on the upper side wall of drain pipe 36 is a lever 64. The front end of the lever 64 is connected by a chain 65 to a lug 42 on the front end of the lower flap valve 48. The rear end of the lever 64 is provided with an angularly disposed end portion 66 having a slot 67. A vertically disposed adjustable length rod 73 comprises an upper strip 83 having a flat recess along the length thereof in which a lower strip 84 is slidingly disposed for relative longitudinal movement. The upper strip 83 has spaced holes 85 therealong. The lower strip 84 has spaced holes 86 therealong which are further apart than the holes 85 on the upper strip 83. Thus, when the strips 83 and 84 are incrementally adjusted longitudinally relative to each other to shorten or lengthen the rod 73, one of the holes in each will be aligned to fittingly receive a screw 90 which is held by a nut 91. The lower strip 84 is provided with a reduced cross section 87 which provides a shoulder 88 intermediate the ends thereof. The rod 73 is inserted in slot 67 of the lever 64 with its shoulder 88 resting on the surface thereof. The upper end of the rod 73 is coupled to arm 69 by a cotter pin 77. An upper chain 76 is connected between a lug 47 on the outer end of the upper flap valve 53 and a clip 78 provided on the upper end portion of the rod 73.

The lower end 79 of the lever 64 is enlarged and cupped to provide for trapping a small amount of water which helps to weight it downwardly about its pivot pin 60 as the water drains from the tank 10 during a full flush. This assures that the lower flap valve 48 will freely fall with the lowering of the water level in the tank so as to be seated on the port 41 of the inlet branch 38 on outlet fitting 29. A stop pin 63 is provided on the side of the drain pipe 36 to limit the upwardly movement of the slotted end portion 66 of the lever 64 when the rod 73 is lifted to effect a partial flush.

It should be noted that the upper and lower flap valves 53 and 48 including the extending arms thereof are made of rubber or a similar flexible material. This facilitates the valves 53 and 48 being readily lifted from and dropped back onto their respective ports 39 and 41 by means of the respective chains 76 and 65 attached to the forward ends thereof.

It should now be clearly understood that to install the dual discharge valve unit 35 of the present invention in an existing flush tank 10, the only modification that needs to be made therein is to remove the ball or flap type valve ordinarily seated on the outlet fitting 29, together with the linkage coupling the valve to the arm 69. As illustrated in FIG. 4, the completely assembled unit 35 is then positioned such that its cylindrical bracket 43 can be slipped over the upper end of the overflow pipe 27 with the lower end 57 of the drain pipe 36 fitted or seated on the angularly disposed port 30 provided on the outlet fitting 29. A bead formed of wax seal 68 is placed about the lip 75 of the port 30 so as to render the joint watertight when the lower end of the drain pipe 36 is fully seated thereon. The unit 35 is then secured in position by clamping the ears 45 on the cylindrical bracket 43 together by tightening the nut and bolt combination 46. With the smaller cross sectional lower end portion 87 of the rod 73 inserted in the slot 67 formed on the rear end portion 66 of the lever 64, the upper end of the properly length adjusted rod 73 is attached by a cotter pin 77 to the arm 69. The unit 35 is now properly installed to discharge water from the full level 80 in the flush tank 10 when operated by actuating handle 44.

If a partial flush is desired, the actuating handle 44 on the outside of the front wall 12 of the flush tank 10 is pivoted counterclockwise in a conventional manner, such that the arm 69 is pivoted upwardly to lift the rod 73, thus pulling up on the upper chain 76 and lifting the upper flap valve 53 thereby enabling a portion of the water in the tank 10 to drain into the upper port 39 of the drain pipe 36 down to a level 92 just above the lower edge of upper port 39. This action causes the ball float 26 to fall with the lowering level of the water in the tank 10 and causes the supply valve 22 to open to permit the water from the supply pipe 18 to flow into the pipe 24 and again fill the tank to its full level 80, at which time the supply valve 22 is automatically closed. Note what when operating the handle 44 to effect a partial flush, the lower end portion 87 of the rod 73 is merely freely lifted relative to the slot 67 on the lever 64 without affecting the position of the latter. The stop pin 63 prevents the lever 64 from tilting during this time.

If a full or complete flush is desired, the actuating handle 44 is rotated clockwise. This causes the rod 73 to push down on the slotted end portion 66 of the lever 64 causing it to rock about its pivot pin 60 such that the lower end 64 of the lever 64 and therefore the upper end of the chain 65 is raised to lift the lower flap valve 48 from the lower seat formed by port 41 enabling water to drain from the tank 10. When the water drains down to the level 93 just above the lower edge of the valve port 41, the lower flap valve 48 again settles back onto its seat and, because the ball float 26 has dropped, the water supply valve 22 is opened and water is admitted into the tank 10 from the water supply pipe 18 until it again rises to the full level 80 and causes the ball float 26 to close supply valve 22.

It should now be clearly understood that, in use, the actuating handle 44 of the water closet may be turned clockwise to selectively lift the lower flap valve 48 to allow a large volume of water to drain from the tank as needed to effect maximum flushing of the closet bowl. On the other hand, if a lesser amount of water from the tank is sufficient to flush the contents of the closet bowl, and to effect a saving of the water, the handle 44 is turned in a counterclockwise direction so that the rod 73 and, therefore, the upper flap valve 53 is selectively lifted. This allows the water to be drained such that approximately half of the volume of water in the tank that would ordinarily be used in the regular flushing of the closet bowl is saved.

It should be particularly pointed out that the drain pipe 36 of the dual discharge valve unit 35 actually serves to extend the height of the port 30 on the outlet fitting 29 such that a flap valve ordinarily seated on the port 30 of an existing flush tank is now, in effect, seated on the port 39 provided on the top of the drain pipe 36. Such an extension further makes it possible to provide the lower inlet branch 38 on the side of the drain pipe 36 which provides the port 41 for the lower flap valve 48. The upper flap valve 53 is thus operated by the upward movement of the arm 69 in a manner similar to the flap valve in an existing flush tank but for the purpose of providing a partial flush, while the lower flap valve 48 is operated by the downward movement of the arm 69 depressing the rod 73 and thereby depressing the slotted end 66 of the lever 64 about its pivot pin for the purpose of providing a full flush of the water closet.

While in order to comply with the statute, the invention has been described in language more or less specific as to structural features, it is to be understood that the invention is not limited to the specific features shown, but that the means and construction herein disclosed comprises a preferred form of putting the invention into effect and the invention is therefore claimed in any of its forms or modifications within the legitimate and valid scope of the appended claims.

What is claimed is:

1. A selective dual discharge flap valve unit for water flush tanks comprising: a central upright drain pipe having an upper valve port on the top thereof and a lower valve port on the side thereof; upper and lower hingedly mounted flap valves respectively seated on said upper and lower valve ports; a lower having a slot on one end thereof pivotally mounted on the side of said drain pipe; an upright rod having an intermediate shoulder disposed with its lower end portion loosely fitted in the slot of said lever; a lower chain connecting the end of said lower flap valve to the end of said lever; and an upper chain connecting the end of said upper flap valve to the upper end portion of said rod; said rod being vertically movable in either direction to respectively selectively lift said upper and lower flap valves.

2. The invention in accordance with claim 1 wherein said upper valve port is disposed at an acute angle with the horizontal and said lower valve port is disposed at an acute angle with the vertical.

3. The invention in accordance with claim 1 wherein said rod is adjustable in length.

4. The invention in accordance with claim 1 wherein the bottom of said drain pipe is reduced in diameter and formed with a cutout.

5. The invention in accordance with claim 1 including means for weighting said lever opposite said sotted end to assist in tilting the lever to close the lower flap valve.

6. The invention in accordance with claim 5 wherein said means for weighting said lever comprises providing a cupped shaped end thereon for trapping water.

7. The invention in accordance with claim 1 including a stop pin on said drain pipe for limiting the upward movement of the slotted end of said lever.

8. A dual discharge valve unit for a water closet flush tank having an actuating handle on the front wall thereof coupled to move an arm within the tank upwardly and downwardly and having an outlet fitting on the bottom wall thereof in combination with an upright overflow pipe, said unit comprising:

an upright drain pipe having a port on the top thereof disposed at an acute angle with the horizontal and having an inlet branch on the lower front thereof with a port disposed at an acute angle with the vertical, the lower end of said drain pipe being adapted to be seated on said outlet with a water tight joint;

a cylindrical bracket on the back of said drain pipe for attaching it on said overflow pipe, said bracket having bosses with pins provided on the opposite sides thereof and said drain pipe having a rod-like portion with end pins provided on the front thereof;

an upper flap valve having a pair of arms extending from the back thereof, said upper flap valve being seated on said port on the top of said drain pipe and having its arms hingedly connected to the pins on the sides of said cylindrical bracket;

a lower flap valve having a pair of arms extending from the back thereof, said lower flap valve being seated on said port on said branch and having its arms hingedly connected to the end pins on said rod-like portion on said drain pipe;

a lever pivotally mounted on the side of said drain pipe, said lever having a slot on the rear end portion thereof;

a vertically disposed rod having a shoulder intermediate the ends thereof with the lower portion thereof freely extending through said slot on said lever, said rod having its upper end coupled to said arm;

an upper chain coupling the front end of said upper flap valve to the upper portion of said rod; and a lower chain coupling the front end of said lower flap valve to the front end of said lever;

whereby when said actuating handle is pivoted counterclockwise said rod is moved upwardly to lift said upper flap valve to provide a partial flush of said water closet; and whereby when said handle is pivoted clockwise said rod is moved downwardly to pivot said lever to lift said lower flap valve to provide a full flush of said water closet.

* * * * *